US007243578B2

(12) United States Patent
Burwell

(10) Patent No.: US 7,243,578 B2
(45) Date of Patent: Jul. 17, 2007

(54) SKATEBOARD TOOL

(76) Inventor: Scott Burwell, 1313 Calle Avanzado, San Clemente, CA (US) 92673

( * ) Notice: Subject to any disclaimer, the term of this patent is extended or adjusted under 35 U.S.C. 154(b) by 0 days.

(21) Appl. No.: 11/300,831

(22) Filed: Dec. 14, 2005

(65) Prior Publication Data

US 2007/0131066 A1 Jun. 14, 2007

(51) Int. Cl.
*B25B 13/00* (2006.01)
*B25B 23/16* (2006.01)
*B25B 33/00* (2006.01)

(52) U.S. Cl. ..... 81/124.4; 81/125.1; 81/177.5

(58) Field of Classification Search ..... 81/124.4, 81/125.1, 177.2, 177.5, 177.75
See application file for complete search history.

(56) References Cited

U.S. PATENT DOCUMENTS 1,168,185 A * 1/1916 Fleck ..... 81/439
1,360,121 A * 11/1920 Lawrence ..... 81/124.4
1,620,262 A * 3/1927 Klaboe ..... 7/167
3,897,703 A * 8/1975 Phipps ..... 81/177.75
4,769,107 A * 9/1988 Helmreich et al. ..... 117/81
4,848,197 A * 7/1989 Kikel ..... 81/440
4,926,721 A * 5/1990 Hsiao ..... 81/177.4
4,936,701 A * 6/1990 Allen et al. ..... 403/57
5,186,083 A * 2/1993 Hsiao ..... 81/124.4
5,365,811 A * 11/1994 Chi ..... 81/439
5,409,332 A * 4/1995 Chabot et al. ..... 403/114
5,421,225 A * 6/1995 Chen ..... 81/490
5,609,079 A * 3/1997 Hashimoto ..... 81/177.75
5,713,252 A * 2/1998 Iwinski et al. ..... 81/439
6,092,441 A * 7/2000 Jarvis ..... 81/177.2
6,739,224 B1 * 5/2004 Wershe ..... 81/437
6,938,521 B1 * 9/2005 Skeens ..... 81/60
2002/0083801 A1 * 7/2002 Cheng ..... 81/177.75
2002/0121164 A1 * 9/2002 Somers ..... 81/177.75

* cited by examiner

*Primary Examiner*—David B. Thomas
(74) *Attorney, Agent, or Firm*—Paul J. Backofen, Esq.; Crockett & Crockett

(57) ABSTRACT

A multifunction tool according to the present disclosure is formed in a generally "Y" shape to provide leverage and control when the tools included in the first arm or the second arm are employed. The main stem includes a ratchet assembly for a male drive element. The male drive element is specifically sized to drive a wobble socket as well as function as a bearing press for skateboard wheels. The wobble socket has offset pivot points to suitably engage the deck fasteners securing the trucks. The first and second arms each include sockets specifically sized for skateboard fasteners. Each arm socket extends from it's respective arm a suitable distance to engage wheel nuts without interference. The intersection of the first and second arms may also include a recess for engaging a separate drive tool for philips head screws and or other suitable recessed drive fasteners such as allen, hex, torx or other fasteners.

1 Claim, 2 Drawing Sheets

SKATEBOARD TOOL

FIELD OF THE INVENTIONS

The inventions described below relate the field of hand tools, and more specifically to the field of multipurpose hand tools for skateboard assembly, maintenance and repair.

BACKGROUND OF THE INVENTIONS

Skateboards have evolved from handmade contraptions made from rollerskate parts attached to a board into specifically engineered and manufactured vehicles capable of impressive performance under the guidance of a skilled rider. The evolution of skateboards and their component parts has made it possible for average and recreational skaters to improve their experience and performance with the use of specifically engineered parts.

While the skateboard components have been evolving, the tools to assemble, maintain and repair them generally remain conventional mechanical tools such as sockets, screwdrivers and the like. With the variety of fastener types and sizes used in a conventional skateboard, a rider usually must have available an appropriate selection of tools to assemble, maintain and repair a skateboard. A suitable selection of tools may be bulky and or expensive and may not be adapted for the geometry of a skateboard.

What is needed is a multifunction tool having appropriate tool elements for all skateboard fasteners that is adapted to the geometry of a skateboard.

SUMMARY

A multifunction tool according to the present disclosure is formed in a generally "Y" shape to provide leverage and control when the tools included in the first arm or the second arm are employed. The main stem includes a ratchet assembly for a male drive element. The male drive element is specifically sized to drive a wobble socket as well as function as a bearing press for skateboard wheels. The wobble socket has offset pivot points to suitably engage the deck fasteners securing the trucks.

The first and second arms each include sockets specifically sized for skateboard fasteners. Each arm socket extends from it's respective arm a suitable distance to engage wheel nuts without interference.

The intersection of the first and second arms may also include a recess for engaging a separate drive tool for philips head screws and or other suitable recessed drive fasteners such as allen, hex, torx or other fasteners.

DETAILED DESCRIPTION OF THE INVENTIONS

Figure 3:
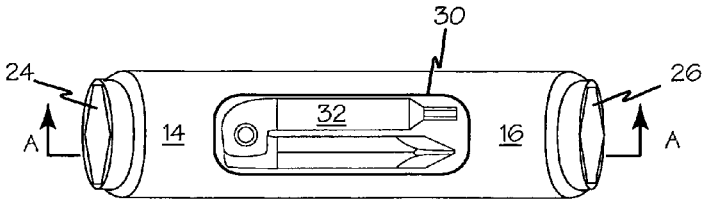
FIG. 3 is a side view of the multifunction skateboard tool of FIG. 1.
Figure 1:
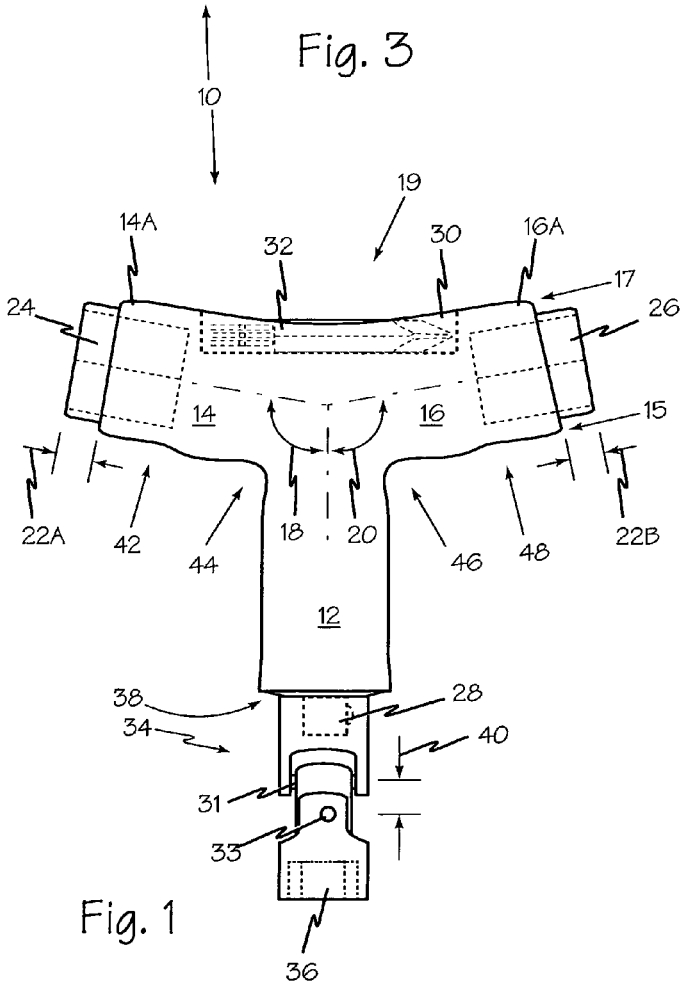
FIG. 1 is a front view of a multifunction skateboard tool according to the present disclosure.
Figure 2:
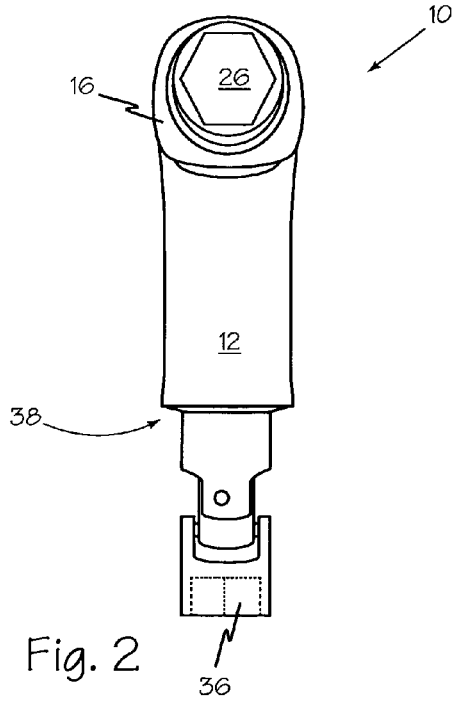
FIG. 2 is a side view of the multifunction skateboard tool of FIG. 1.

FIG. 1 is a front view of multipurpose tool 10, FIG. 2 is a side view and FIG. 3 is a top view. Multipurpose tool 10 is generally "Y" shaped including main stem 12, first arm 14 and second arm 16. First arm 14, second arm 16 and main stem 12 are coplanar. The "Y" shape is determined by angles 18 and 20 formed between first arm 14 and main stem 12 and second arm 16 and main stem 12 respectively. Angles 18 and 20 may be the same or different and are generally obtuse angles between 93° and 120°.

Most dimensions and sizes are presented here in English or SAE units. Any other suitable measurement or standard sizes may be used such as for example Metric units. The tools and drive elements may be all SAE, all metric or any suitable combination.

First arm 14 includes a tool 24 partially embedded and extending from end 14A. Second arm 16 includes a tool 26 partially embedded and extending from end 16A. Tools 24 and 26 may be any suitable tool such as a socket having any suitable number of faces or points such as a hex socket having six sides. example tool 24 may be 9/16 inch and tool 26 may be ½ inch. Relief 22A and 22B for tools 24 and 26 respectively is formed by the partial embedment of the tools within their respective arms and permits tools 24 and 26 to engage axle nuts within skateboard wheels with minimal interference. Relief 22A and 22B may be any suitable dimension such as 3/16 inch.

The combination of arms 14 and 16 may be identified as handle 19. Handle 19 has a top side 17 and a bottom side 15. Bottom side 15 includes the intersection with main stem 12 and finger indentions 42, 44, 46 and 48. Finger indentions 44 and 46 may also extend into main stem 12. Handle top 17 is opposite the intersection of handle 19 and main stem 12 and may include recess 30. Recess 30 may engage any suitable removable tool or combination of tools. For example, tool 32 may be a combination Phillips head screwdriver and allen head driver.

Main stem 12 may house any suitable ratchet mechanism supporting drive end 28. Drive end 28 is a male end and is sized such that in combination with shoulder 38 may function as a bearing press for installing bearings into skateboard wheels. Drive end 28 engages wobble drive 34. Wobble drive is a female—female drive element with pivot pins 31 and 33 separated by offset 40. Wobble socket 36 may have any suitable dimensions such as for example ⅜ inch hex.

Figure 4:
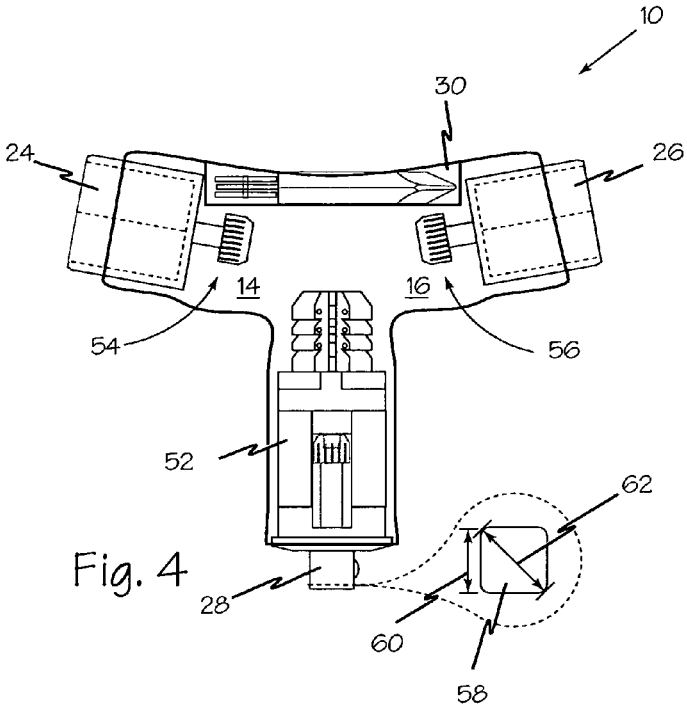
FIG. 4 is a cutaway view of the multifunction skateboard tool of FIG. 3 taken along line A—A.

Referring now to FIG. 4, main stem 12 of multipurpose tool 10 may include any suitable ratchet device 52 attached to drive 28 to permit motion of drive 28 relative to main stem 12. Alternatively, drive 28 may be secured within main stem 12 in a fixed position. Cross-section 58 of drive 28 may be square with length 60 of the sides may be 6 mm and diagonal length 62 may be 7 mm. Dimensions 60 and 62 are selected to permit drive 28 to be a centering element when main stem 12 is used as a bearing press. Any other suitable dimensions may be used.

Tool 24 may be secured within first arm 14 by any suitable element such as for example toothed stem 54. Similarly, tool 26 may be secured within second arm 16 by any suitable element such as for example toothed stem 56.

Figure 5A:
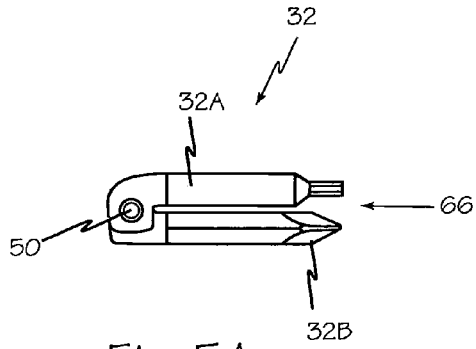
FIG. 5A is a front view of a removable tool in a storage position according to the present disclosure.
Figure 5B:
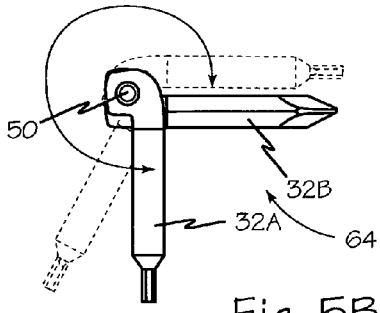
FIG. 5B is a front view of the removable tool of FIG. 5A in an open position.

Referring now to FIG. 5A and FIG. 5B, removable tool 32 may be composed of one or more tool elements such as phillips element 32B and allen element 32A. Tool elements may be joined together with pivot 50 to permit relative counter rotation of phillips element 32B and allen element

32A about pivot 50 from open position 64 to closed position 66 and from closed position 66 to open position 64.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A multipurpose tool comprising:

a first arm having a common end and a tool end, a first tool partially embedded within the tool end;

a second arm having a common end and a tool end, a second tool partially embedded within the tool end;

a main stem having a common end and a tool end, a drive element partially embedded within the tool end, the common end of the first arm joined to the common end of the second arm and the common end of the main stem in a common plane forming an obtuse angle between the first arm and the main stem and an obtuse angle between the second arm and the main stem, the common end of the first arm and the common end of the second arm forming a handle having a top and a bottom, the top including a tool recess, and the bottom having a plurality of finger indentions.

* * * * *